US006241033B1

(12) United States Patent
Hoffman

(10) Patent No.: US 6,241,033 B1
(45) Date of Patent: Jun. 5, 2001

(54) DRILL STRING APPARATUS AND METHOD OF EXTENDING THE LENGTH OF A DRILL STRING

(75) Inventor: Pieter Hoffman, Roodepoort (ZA)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/347,274

(22) Filed: Jul. 6, 1999

(30) Foreign Application Priority Data

Jul. 7, 1998 (ZA) ..... 98/5985

(51) Int. Cl.[7] ..... E21B 10/26
(52) U.S. Cl. ..... 175/320; 175/389
(58) Field of Search ..... 175/21, 320, 414, 175/415, 417, 389, 135; 173/80, 102, 126; 166/241

(56) References Cited

U.S. PATENT DOCUMENTS 4,094,364 * 6/1978 Lundstrom et al. ..... 173/80
4,852,672 * 8/1989 Behrens ..... 175/389
6,102,141 * 8/2000 Engstrom et al. ..... 175/417

* cited by examiner

*Primary Examiner*—Robert E. Pezzuto
(74) *Attorney, Agent, or Firm*—Burns, Doane, Swecker & Mathis, L.L.P.

(57) ABSTRACT

A percussive drilling mechanism includes a percussive hammer and a drill string connected to the hammer. The drill string includes a plurality of identically shaped shank rods interconnected to one another. To extend the drill string, a trailing one of the shank rods is removed from the hammer, and a new shank rod is interposed between the hammer and that removed shank rod.

8 Claims, 3 Drawing Sheets

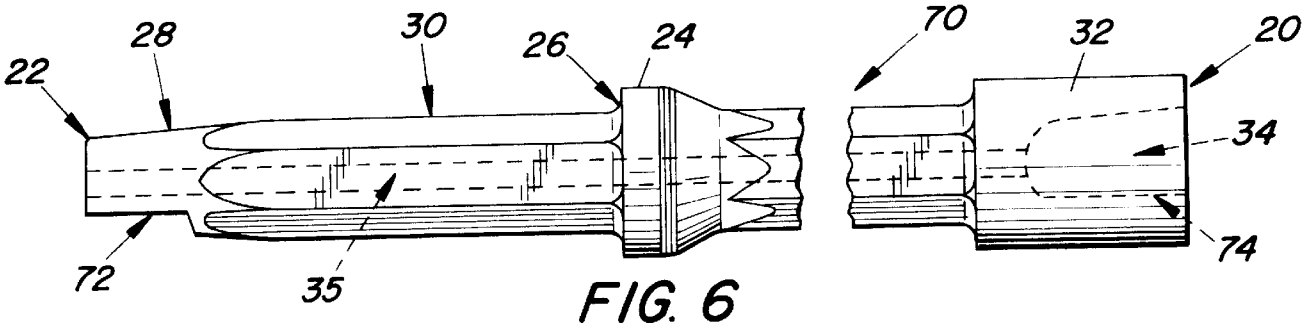
FIG. 6
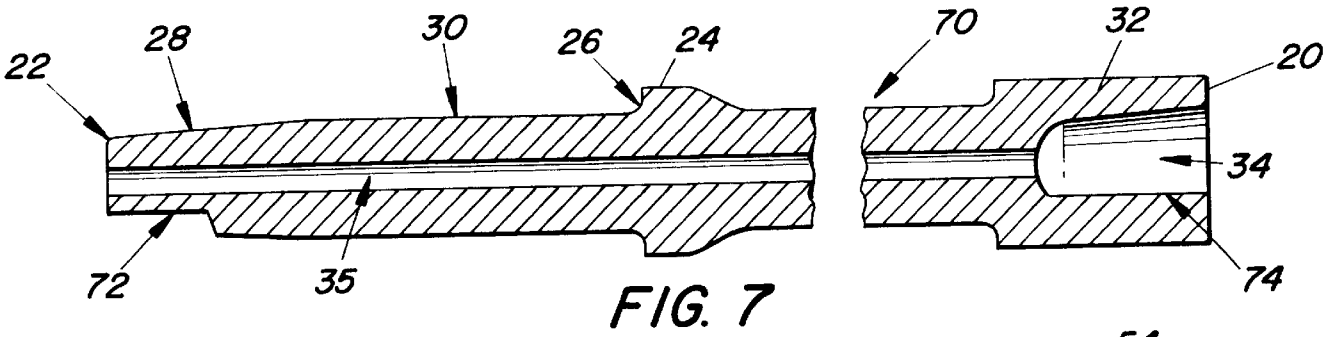
FIG. 7
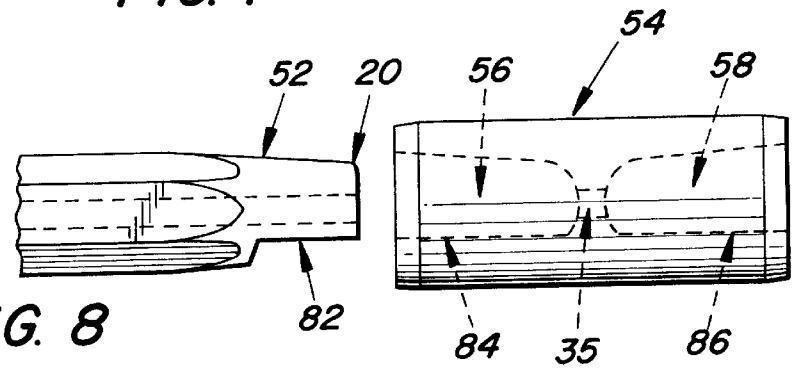
FIG. 8
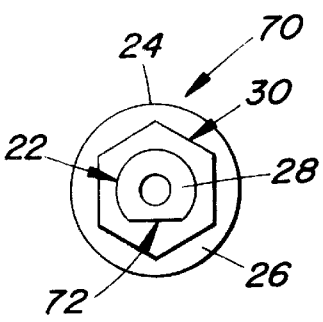
FIG. 9
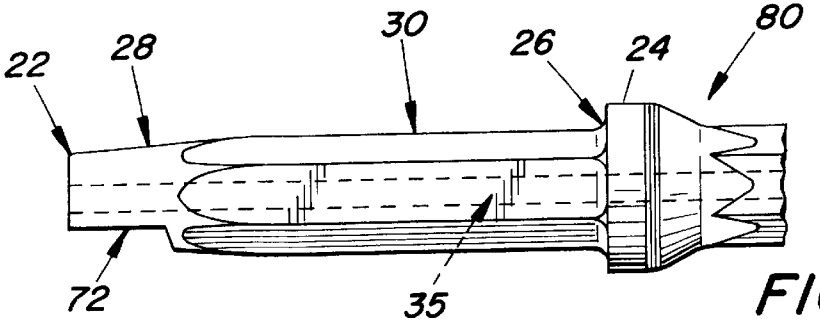

DRILL STRING APPARATUS AND METHOD OF EXTENDING THE LENGTH OF A DRILL STRING

BACKGROUND OF THE INVENTION

This invention relates to drilling. More particularly, the invention relates to a method of extending the length of a drill string. It also relates to a drill string element and to a coupling member. It further relates to a shank rod and to a drill string.

In top hammer drilling, use is made of a hammer which rotates and applies an axial percussive load to a drill string in order to drill holes in the ground.

The drill string comprises a first member mounted in the hammer to which one or more extension rods are connected end-to-end. A drill bit is provided at the leading end of the drill string.

The first member, herein called a "shank rod", typically includes an elongate shank having a leading end and a trailing end. An annular collar is provided on the shank rod intermediate the leading end and the trailing end. At least part of the shank rod between the trailing end and the collar is non-circular in cross-section such that when a trailing end portion of the shank rod is positioned in the hammer, the hammer can engage the non-circular portion to rotate the drill string and apply axial percussive loads to the trailing end of the shank rod. The leading end of the shank rod is configured to be connected to a trailing end of the rearmost (uppermost) extension rod of the drill string.

As drilling proceeds and the drill string penetrates deeper into the ground it becomes necessary periodically to extend the length of the drill string. This is achieved by disconnecting the leading end of the shank rod from the trailing end of the rearmost (uppermost) extension rod, and connecting a leading end of a new extension rod to the trailing end of the rearmost extension rod and connecting a trailing end of the new extension rod to the leading end of the shank rod.

One disadvantage with this procedure is that it is relatively time consuming. A further disadvantage is that in certain applications, e.g., in stope drilling, space is restricted, which can make it extremely difficult to connect a new extension rod in position between the shank rod and the rearmost extension rod.

It is an object of this invention to alleviate these problems.

SUMMARY OF THE INVENTION

According to one aspect of the invention there is provided a method of extending the length of a drill string which includes a shank rod, a trailing end portion of which is positioned in a hammer, the method including the steps of:

disconnecting the shank rod from the hammer;

mounting a subsequent shank rod in the hammer; and connecting a leading end of said subsequent shank rod to a trailing end of the previous shank rod.

It is to be appreciated that the shank rod being disconnected from the hammer remains attached to the drill bit or remainder of the drill string and hence forms an element of the drill string, This procedure can be repeated as often as desired with, each time, a leading end of a subsequent shank rod being connected to a trailing end of a previous shank rod.

In this way, the drill string is extended making use of drill string elements which functioned initially as shank rods and subsequently as extension rods.

In one embodiment of the invention, connecting a leading end of the subsequent shank rod to the trailing end of the previous shank rod may include positioning a connecting member integral with the subsequent shank rod at the leading end thereof in driving engagement with the trailing end of the previous shank rod.

In another embodiment of the invention, connecting a leading end of the subsequent shank rod drivingly to the trailing end of the previous shank rod may be by means of a coupling member which is interposed between the shank rods.

According to another aspect of the invention there is provided a drill string element which includes:

an elongate shank having a leading end and a trailing end;

a collar provided on the shank intermediate the leading end and the trailing end, at least part of the shank between the trailing end and the collar being receivable in a hammer and being of non-circular cross-section for at least part of its length; and connecting formations at the leading end and trailing end of the shank whereby the drill string element is connectable end-to-end to a similar drill string element.

In one embodiment of the invention, the connecting formations may be configured such that the connecting formation at the leading end of the shank of one drill string element is connectable to the connecting formation at the trailing end of the shank of another drill string element by means of a coupling member having complementary connecting formations which is interposed between the drill string elements.

The connecting formations may be in the form of tapered end portions.

At least one of the tapered end portions may be noncircular in cross-section for at least part of its length.

In another embodiment of the invention, the connecting formations may be complementary in shape such that the connecting formation at the leading end of the shank is releasably and drivingly connectable to the complementary connecting formation at the trailing end of the shank of a similar drill string element.

The one connecting formation may be in the form of a tapered end portion and the other connecting formation being in the form of a complementary socket.

The tapered end port-Ion is typically provided at the trailing end of the shank, and the complementary socket is provided at the leading end of the shank.

The tapered end portion and socket may be of complementary non-circular cross-section for at least part of their lengths.

According to another aspect of the invention there is provided a coupling member for drivingly connecting together a pair of drill string elements as described above, which defines a pair of oppositely disposed tapering sockets interconnected by a flushing passage, at least one of the tapering sockets being of non-circular cross-section for at least part of its length.

Each socket may have at least one flat surface.

According to still another aspect of the invention there is provided a shank rod suitable for use in the above method, which rod has at a trailing end thereof connecting means whereby it is connectable to a leading end of another similar shank rod.

The connecting means may include a taper at the trailing end of the shank rod.

In one embodiment of the invention, the leading end of the shank rod may define a complementary tapered socket within which a tapered trailing end of another similar shank rod is taper lockingly receivable.

In another embodiment of the invention, the leading end of the shank rod may be tapered. Hence, a leading end of a shank rod of this type will be connectable to a trailing end of a similar shank rod by means of a coupling member having a pair of oppositely disposed complementary tapered sockets within which the leading end of one shank rod and the trailing end of the other shank rod are taper lockingly receivable.

The or each tapered end portion of the shank rod may be non-circular in cross-section for at least part of its length.

According to still another aspect of the invention there is provided a drill string which includes at least one of a shank rod, drill string element and coupling member of the type described above.

BRIEF DESCRIPTION OF THE DRAWINGS

The objects and advantages of the invention will become apparent from the following detailed description of preferred embodiments thereof in connection with the accompanying drawings, in which like numerals designate like elements, and in which

FIGS. 6 to 8 show views similar to FIGS. 3 to 5, respectively, of modified drill string elements in accordance with the invention—and FIG. 9 shows an end view of the drill string element shown in FIG. 6 of the drawings.

DETAILED DESCRIPTION OF PREFERRED EMBODIMENTS OF THE INVENTION

Figure 1:
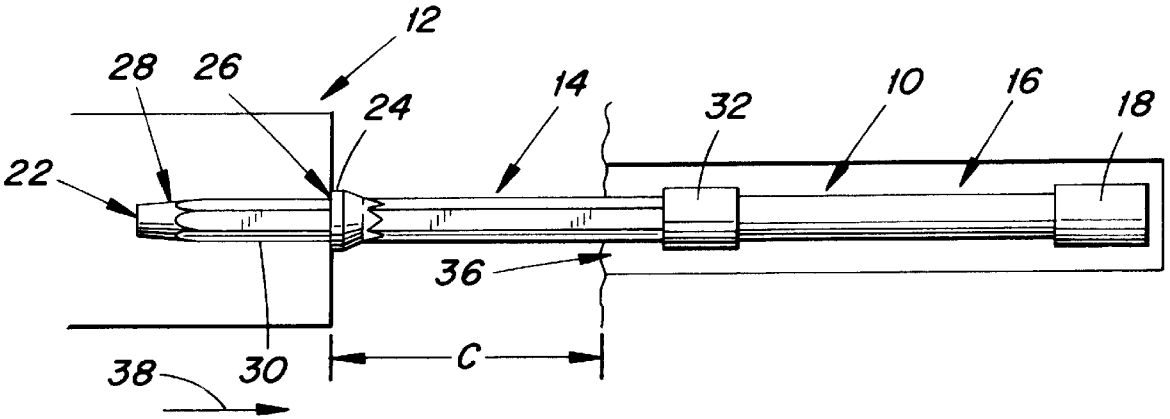
FIG. 1 shows schematically a sectional view of a hole being drilled making use of a drill string element in accordance with the invention.
Figure 2:
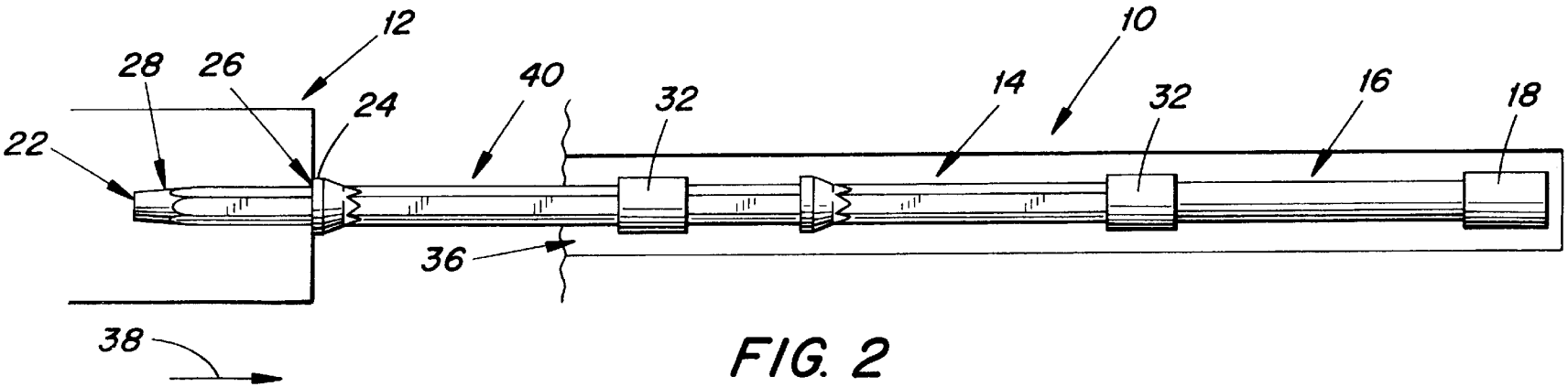
FIG. 2 shows a view similar to FIG. 1 at a later stage in the drilling of the hole.

In FIGS. 1 and 2 of the drawings, reference numeral 10 refers generally to a drill string in accordance with the invention. Reference numeral 12 refers generally to a hammer for top drilling.

The drill string 10 includes a first drill string element in the form of a shank rod 14, an extension rod 16 connected at its trailing end to a leading end of the shank rod 14 and a drill bit 18 connected to the leading end of the extension rod 16.

Figure 3:
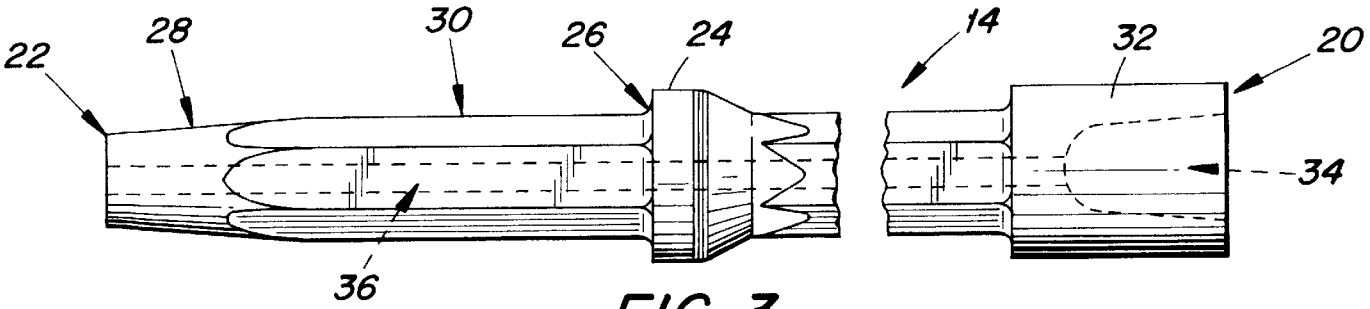
FIG. 3 shows a side view of a drill string element in accordance with the invention which forms part of the drill string of FIGS. 1 and 2.
Figure 4:
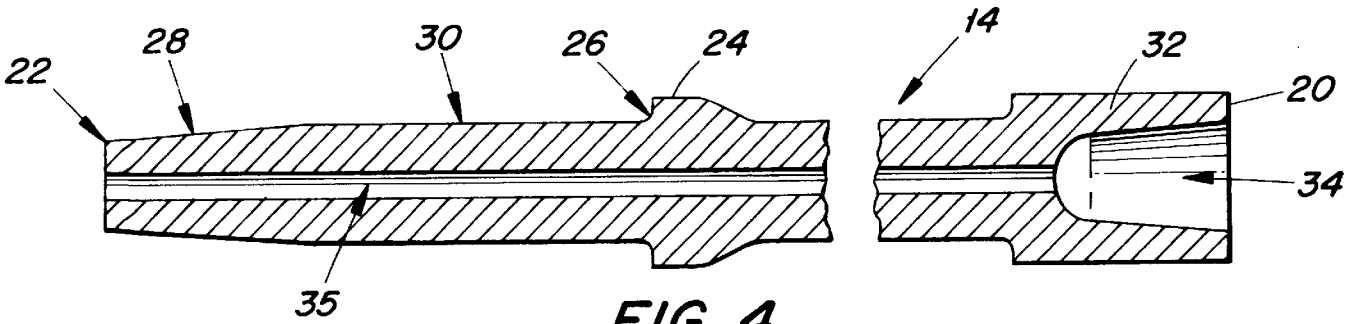
FIG. 4 shows a longitudinal sectional view of the drill string element of FIG. 3.

Referring now also to FIGS. 3 and 4 of the drawings, the drill string element or shank rod 14 includes a leading end 20 and a trailing end 22. An annular collar 24 is provided at a position intermediate the trailing end 22 and the leading end 20. Usually, the collar 24 will be closer to the trailing end 22 than the leading end 20. The collar 24 defines an annular shoulder 26 against which the hammer 12 abuts as is described in more detail herebelow.

A trailing end portion of the shank rod 14 is provided with a taper 28, and the portion of the shank rod generally designated by reference numeral 30 intermediate the taper 28 and the shoulder 26 is noncircular in cross-section, in particular hexagonal.

A leading end portion of the shank rod 14 is in the form of a socket member 32 which defines a tapered socket 34 which is complementary to the taper 28 such that the tapered portion 28 of a similar shank rod 14 is frictionally securable in the socket 34 by a taper lock.

The extension rod 16 has a trailing portion which is tapered such that it is receivable in the socket 34 and frictionally securable therein by a taper lock, and a tapered leading end portion on which the drill bit 18 frictionally secured by a taper lock.

A flushing passage 35 extends through a center passage of each of the elements of the drill string in order to convey flushing medium through the drill string to flush the hole being drilled, on a continuous basis.

In use, in order to drill a hole 36, e.g., in a stope, the drill bit 18 is mounted on a leading end portion of the extension rod 16, and a trailing end portion of the extension rod 16 is mounted in the socket 34. The shank rod 14 is mounted in the hammer 12 such that the hammer engages the portion 30 and the shoulder 26. The hammer is operated and rotates the drill string 1 0 whilst simultaneously applying axial percussive loads to the trailing end 22. Simultaneously, the hammer 12 is urged (fed) in the direction of arrow 38 (FIGS. 1 and 2). The combination of the rotation, axial load and axial percussive load causes the drill bit 18 to drill into the rock to form the hole 36.

As the depth of the hole 36 increases, a leading end portion of the shank rod 14 follows the drill bit 18 and the extension rod 16 into the hole 36. Eventually, the working clearance C between the hammer 12 and the rock around the mouth of the hole 36 reaches a predetermined minimum working clearance at which stage, in order to continue drilling, it is necessary to extend the length of the drill string. This is achieved by disconnecting the hammer 12 from the shank rod 14. A subsequent shank rod 40 (FIG. 2) which is substantially identical to shank rod 14 is connected to the shank rod 14 by positioning the socket 34 of the shank rod 40 over the taper 28 of the shank rod 14 such that the shank rods 14, 40 are taper lockingly connected to one another. The trailing end portion of the shank rod 40 is then positioned in the hammer 12 and drilling can continue in the manner described above.

This procedure can be repeated until the hole 36 reaches a desired depth.

In order to remove the drill string 10 from the hole 36, the hammer 12 is disconnected from the trailing end portion of the shank rod 40. The remainder of the drill string 10 is withdrawn from the hole and when it has been withdrawn sufficiently far, the rearmost shank rod is disconnected from the drill string. The drill string 10 is then further withdrawn and the rearmost shank rods are successively disconnected. Disconnecting the rearmost shank rods from the drill string is done by hand or with the aid of a "knock-off tool" (not shown).

Figure 5:
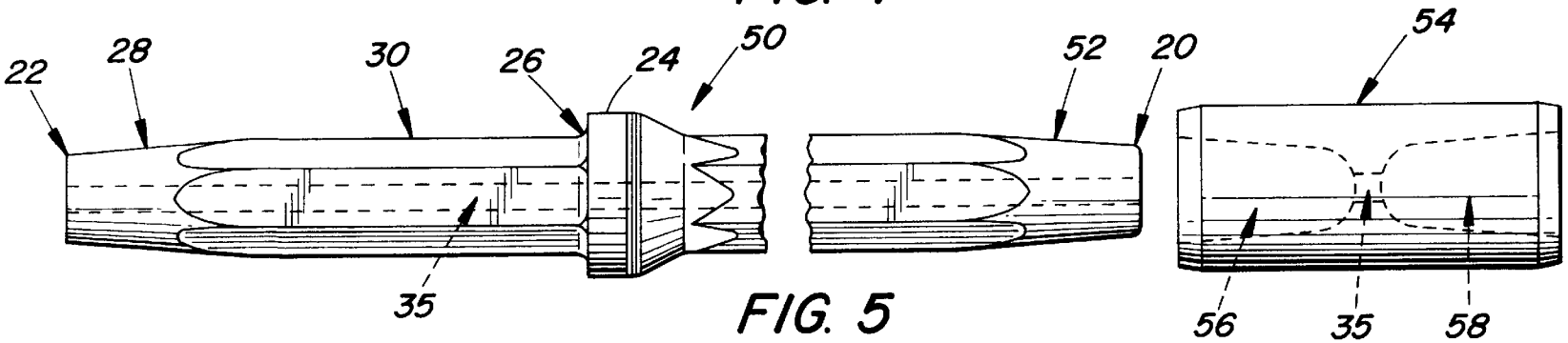
FIG. 5 shows an exploded side view of another drill string element in accordance with the invention together with a coupling member in accordance with the invention whereby the drill string element is connectable to another similar drill string element.

Reference is now made to FIG. 5 of the drawings, in which reference numeral 50 refers generally to another drill string element in the form of a shank rod in accordance with the invention and, unless otherwise indicated, the same reference numerals used above are used to designate similar parts. The main difference between the shank rod 50 and the shank rod 14 is that, in the case of the shank rod 50 a leading end portion is indicated by reference numeral 52. In order to connect the leading end of the shank rod 50 to the trailing end of a similar shank rod 50 or an extension rod, use is made of a coupling member which defines a tapered socket 56 within which the tapered leading end portion 52 is taper-lockingly receivable, The coupling member 54 also defines a complementary connecting formation which is connectable to the trailing end of a shank rod or extension rod. In the embodiment shown, the complementary connecting formation is in the form of a tapered socket 58 which is oppositely disposed to the tapered socket 56 and configured such that the taper 28 is taper lockingly receivable therein. The shank rod 50 will be used in substantially identical fashion to the shank rod 14. It will be appreciated, however, that in this embodiment of the invention, the drill bit 18 could be mounted directly onto the leading end portion 52 without requiring the use of an extension rod 16. Accordingly, with the exception of the drill bit 18 the entire drill string 10 could be made up of one or more of the shank rods 50.

Reference is now made to FIGS. 6, 7 and 9 of the drawings, in which reference numeral 70 refers generally to yet another drill string element in the form of a shank rod in accordance with the invention and, unless otherwise indicated, the same reference numerals used in FIGS. 3 and 4 of the drawings, are used to designate similar parts.

The main difference between the shank rod 70 and the shank rod 14 is that, in the case of the shank rod 70, complementary flats 72,74 are provided on the taper 28 and in the socket 34, respectively. This provides the taper 28 and the socket 34 with complementary non-circular cross-sections such that when the taper 28 of one shank rod 70 is received in the socket 34 of another shank rod 70, the shank rods are taper-lockingly connected together by virtue of the tapers of the taper 28 and socket 34. Also, by virtue of their noncircular cross-section relative rotation between the shank rods 70 is inhibited.

Similarly, reference is now made to FIG. 8 of the drawings, in which reference numeral 80 refers generally to yet another drill string element in the form of a shank rod in accordance with the invention and, unless otherwise indicated, the same reference numerals used in FIG. 5 of the drawings, are used to designate similar parts.

In this embodiment of the invention, both of the tapers 28,52 are provided with flats 72,82, respectively. Similarly, the sockets 56,58 are provided with complementary flats 84,86 respectively, which, when the coupling member 54 is mounted on the shank rod 80 serve to inhibit relative rotation between the shank rod 80 and the coupling member 54.

It is believed that the invention will permit extension of the length of a drill string more easily and quickly than was possible in the past, particularly in confined areas such as in stopes, which in turn will lead to an increase in productivity.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A percussive drilling apparatus comprising:

a percussive hammer;

a plurality of interconnected identically-shaped shank rods, each comprising an elongated shank having a leading end and a trailing end, a collar provided on the shank intermediate the leading end and the trailing end, at least a part of the shank between the trailing end and the collar being of non-circular cross-section, and complementary shaped connecting formations at the leading end and the trailing end;

a rearwardmost one of the shank rods having its trailing end connected to the hammer, whereby the part of the shank thereof which is of non-circular cross-section is disposed in the hammer and the collar is arranged to receive impacts from the hammer, and a leading end of the rearwardmost shank rod being connected to a trailing end of another of the shank rods; and a drill bit carried by a leading one of the shank rods.

2. The percussive drilling apparatus according to claim 1, further including an extension rod of different configuration than the shank rods, the extension rod being secured to the leading end of a forwardmost one of the shank rods, the drill bit being disposed on the extension rod.

3. The percussive drilling apparatus as claimed in claim 1, in which the connecting formations comprise tapered end portions.

4. The percussive drilling apparatus as claimed in claim 3, in which at least one of the tapered end portions is non-circular in cross-section for at least part of its length.

5. The percussive drilling apparatus as claimed in claim 1, in which the connecting formations are complementary in shape such that the connecting formation at the leading end of the shank is releasably and drivingly connectable to the complementary connecting formation at the trailing end of shank of a similar drill string element.

6. The percussive drilling apparatus as claimed in claim 5, in which one of the connecting formations is in the form of a tapered end portion and the other connecting formation is in the form of a complementary shaped tapered socket.

7. The percussive drilling apparatus as claimed in claim 6, in which the tapered end portion is provided at the trailing end of the shank and the socket is provided at the leading end of the shank.

8. The percussive drilling apparatus as claimed in claim 6 in which the tapered end portion and the socket are of complementary shaped non-circular cross-section for at least part of their lengths.

* * * * *